US008727502B2

(12) United States Patent
Paeng et al.

(10) Patent No.: US 8,727,502 B2
(45) Date of Patent: May 20, 2014

(54) INKJET PRINT HEAD WITH FLOW-PATH MICRO-PATTERN AND MANUFACTURING METHOD THEREOF

(71) Applicant: Samsung Electronics Co., Ltd., Suwon-si (KR)

(72) Inventors: Dong Woo Paeng, Anyang-si (KR); Dae Jung Kim, Seoul (KR); Chi Won Moon, Suwon-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/726,819

(22) Filed: Dec. 26, 2012

(65) Prior Publication Data

US 2013/0169715 A1 Jul. 4, 2013

(30) Foreign Application Priority Data

Dec. 31, 2011 (KR) ..... 10-2011-0148004

(51) Int. Cl.
*B41J 2/05* (2006.01)

(52) U.S. Cl.
USPC ..... 347/65; 347/94; 347/20

(58) Field of Classification Search
USPC ..... 347/20, 56, 61–65, 67, 92–94
See application file for complete search history.

(56) References Cited

U.S. PATENT DOCUMENTS 5,896,150 A * 4/1999 Kobayashi et al. ..... 347/54
7,083,267 B2 * 8/2006 Kawamura et al. ..... 347/65

* cited by examiner

*Primary Examiner* — Juanita D Jackson
(74) *Attorney, Agent, or Firm* — F. Chau & Associates, LLC

(57) ABSTRACT

An inkjet print head configured to smoothly discharge high viscosity ink includes a nozzle part configured to discharge ink, a supply flow path part configured to define a flow path to supply ink to be discharged from the nozzle part, and a micro pattern part formed at least one portion of the supply flow path part that is configured to reduce of a flow resistance of the ink flowing through the supply flow path part.

20 Claims, 6 Drawing Sheets

INKJET PRINT HEAD WITH FLOW-PATH MICRO-PATTERN AND MANUFACTURING METHOD THEREOF

CROSS-REFERENCE TO RELATED APPLICATION

This application claims priority from Korean Patent Application No. 10-2011-0148004, filed on Dec. 31, 2011, in the Korean Intellectual Property Office, the contents of which are herein incorporated by reference in their entirety.

BACKGROUND

1. Field

Embodiments of the present disclosure are directed to an inkjet print head having a structure configured to reduce a flow path resistance inside a head, and a manufacturing method thereof.

2. Discussion of the Related Art

In general, an inkjet print head is an apparatus configured to print an image of a predetermined color on a surface of a printed medium by discharging a fine liquid drop of ink at a desired position.

Inkjet print heads may be classified into two types according to a method of discharging ink. One method is a thermal method configured to generate bubbles in the ink by using a heat source, and the expansion of the bubbles discharges the ink. The other method is a piezoelectric method configured to discharge ink by the pressure being applied to the ink using a piezoelectric material that is deformed by an applied voltage.

The inkjet print head may also be classified by purpose into a for-print-purpose inkjet print head configured to form an image on paper or a printed medium, and an industrial-purpose inkjet print head for use in the manufacturing process of an LCD (Liquid Crystal Display). For an industrial-purpose inkjet print head, high viscosity ink is frequently used, however, as the ink viscosity increases, the flow resistance of the ink increases, which may render unstable the ink discharge in the last stage.

SUMMARY

It is an aspect of the present disclosure to provide an inkjet print head configured to smoothly discharge high viscosity ink, and a manufacturing method thereof.

It is another aspect of the present disclosure to provide an inkjet print head capable of applying high viscosity ink without additional apparatus configured to lower the ink viscosity, and a manufacturing method thereof.

In accordance with an aspect of the present disclosure, an inkjet print head includes a nozzle part, a supply flow path part and a micro pattern part. The nozzle part may be configured to discharge ink. The supply flow path part may define a flow path to supply ink to be discharged from the nozzle part. The micro pattern part may be formed on at least one portion of the supply flow path part and is configured to reduce a flow resistance of ink flowing through the supply flow path part.

The micro pattern part may have a plurality of grooves.

Each groove may have a V-shaped cross section thereof.

Each groove may extend lengthways perpendicular to an ink flow direction through the flow path.

Each groove may have a circular cross section thereof.

Each groove may have an elliptical cross section thereof.

A long axis of each elliptical shape may be parallel to the ink flow direction through the flow path.

Each groove may have a rhombus shaped cross section thereof.

The micro pattern part may be formed using a femtosecond laser.

In accordance with another aspect of the present disclosure, a method of manufacturing an inkjet print head having a supply flow path part that defines a flow path configured to supply ink to be discharged includes forming a micro pattern in the supply flow path part.

The micro pattern may be formed using a femtosecond laser.

The micro pattern part may be formed to have a plurality of grooves.

Each groove may have a V-shaped cross section thereof.

Each groove may have a circular cross section thereof having a circular shape.

Each groove may have an elliptical cross section thereof.

A wavelength of the femtosecond laser is selected so that light emitted from the laser may penetrate a material comprising the supply flow path part.

In accordance with another aspect of the present disclosure, an inkjet print head includes a supply flow path part and a micro pattern part. The supply flow path part may define a flow path to supply ink to be discharged from the inkjet print head. The micro pattern part may be formed of a plurality of grooves on at least one portion of the supply flow path part, and may be configured to induce turbulence in the ink that flows through the supply flow path part. The turbulence can reduce a flow resistance of the ink flowing through the supply flow path part.

The inkjet print head may include a nozzle part connected to an end of the supply flow path part, the nozzle part being configured to discharge the ink.

Each of the plurality of grooves may have a V-shaped cross section and may extend lengthways in a direction perpendicular to an ink flow direction.

Each of the plurality of grooves may have one of a circular cross section, an elliptical cross section, or a rhombus shaped cross section.

DETAILED DESCRIPTION OF EXEMPLARY EMBODIMENTS

Figure 1:
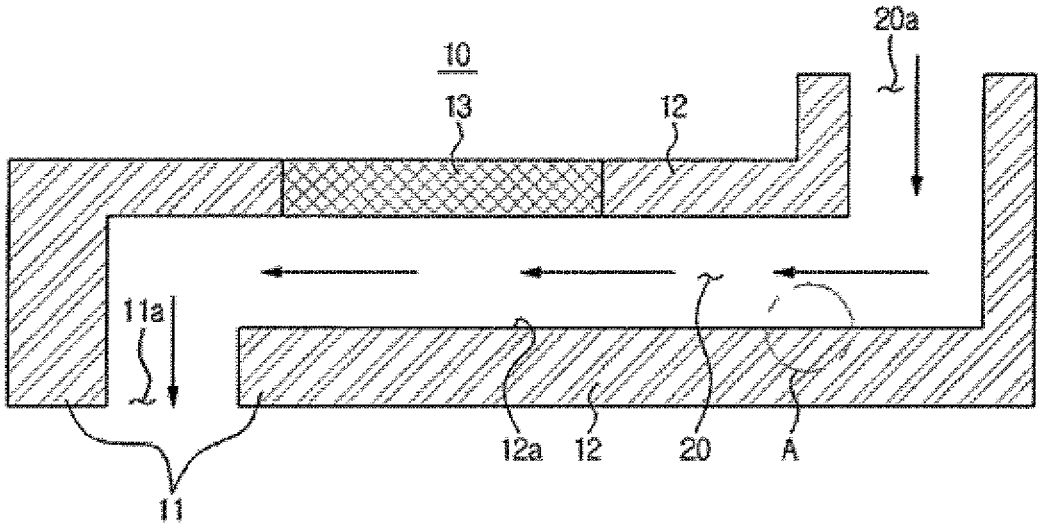
FIG. 1 is a schematic view of an inkjet print head in accordance with one embodiment of the present disclosure.

Reference will now be made in detail to the embodiments of the present disclosure, examples of which are illustrated in the accompanying drawings, wherein like reference numerals refer to like elements throughout.

Figure 2:
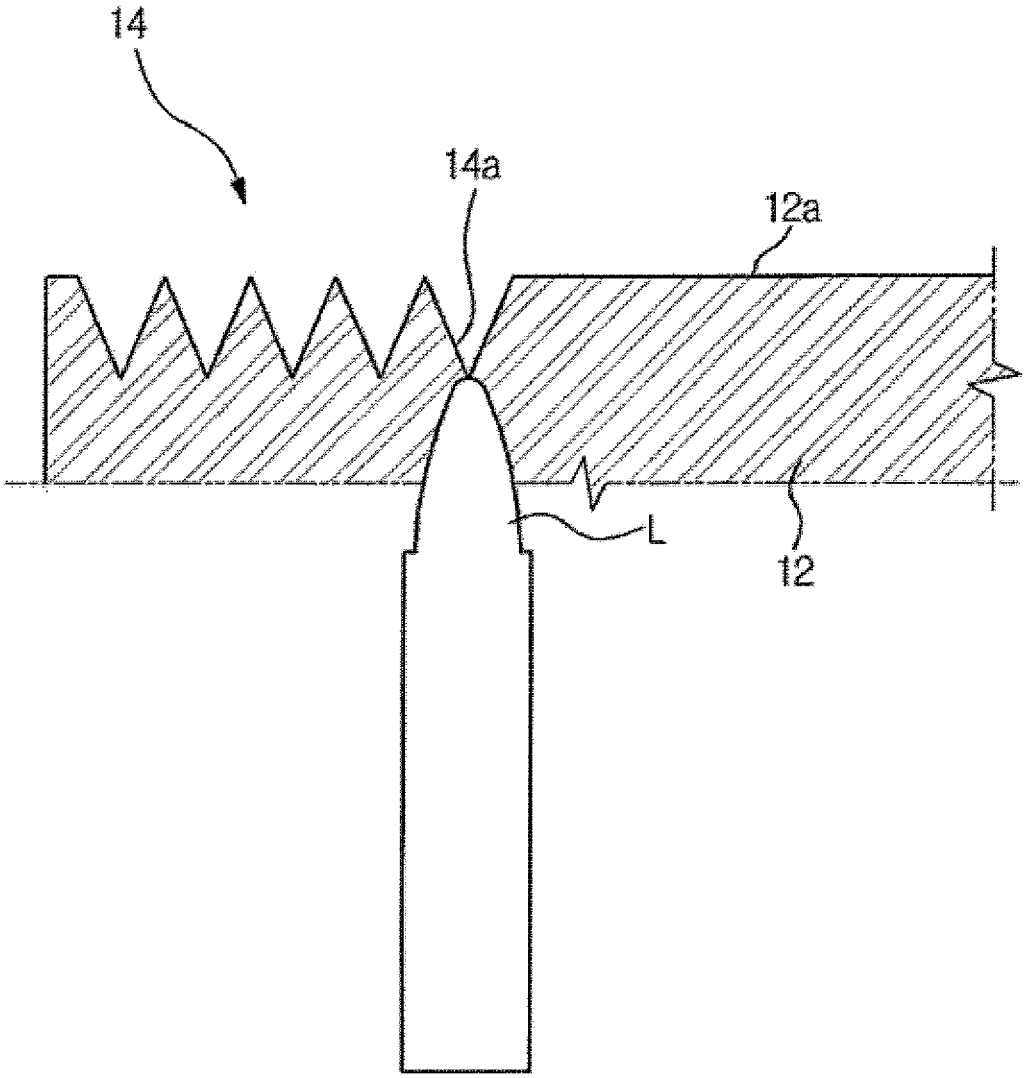
FIG. 2 is an enlarged view of a 'section A' of FIG. 1.

FIG. 1 is a schematic view of an inkjet print head in accordance with one embodiment of the present disclosure, and FIG. 2 is an enlarged view of a 'section A' of FIG. 1. Referring to FIGS. 1 to 2, an inkjet print head 10 includes a nozzle part 11 to discharge ink, a supply flow path part 12 forming a flow path 20 to supply the ink to the nozzle part 11 to be discharged therefrom, and a driving part 13 providing a discharge pressure to the ink so that the ink may be discharged from the nozzle part 11.

The nozzle part 11 is provided with a nozzle hole 11*a* at a lower portion thereof configured to perform as a path to discharge ink, and the nozzle hole 11*a* is in fluid communication with the flow path 20 of the supply flow path part 12.

The flow path 20 of the supply flow path part 12 includes an ink inlet hole 20*a* through which ink is received from an ink reservoir (not shown), and the driving part 13 is disposed in the flow path 20 to apply pressure to the ink inside the supply flow path 20 so that the ink may be discharged from the nozzle hole 11*a*.

In accordance with an embodiment of the present disclosure, the inkjet print head 10 may utilize a piezoelectric scheme, and the driving part 13 may be provided with a piezoelectric actuator configured to apply pressure to the ink due to the piezoelectric effect.

An inner surface 12*a* of the supply flow path part 12, while defining the flow path 20 of the ink, is connected to the nozzle part 11, and a micro pattern part 14 may be provided for the entire area or for a portion of the inner surface of the supply flow path part 12, so that the ink flowing through the flow path 20 may flow smoothly.

The micro pattern part 14, for reducing the flow resistance of the ink that is flowing along the flow path 20 of the supply flow path part 12, may be formed at the inner surface 12*a* of the supply flow path part 12 to induce turbulence in the ink flow.

As the flow resistance of the ink flowing through the supply flow path part 12 is reduced by the micro pattern part 14, even for a high viscosity ink, the ink need not be heated to reduce the ink viscosity. Thus, an additional apparatus, such as a heater, an ultrasonic wave generator, or an electromagnetic field generator, configured to reduce the ink viscosity may be omitted from the inkjet print head 10, thereby enabling miniaturization of the inkjet print head 10, which may reduce spatial limitations when disposing of inkjet print heads 10, as well as reducing the production cost of the inkjet print head 10.

The micro pattern part 14 comprises a plurality of unit nano patterns whose size varies from several nanometers (nm) to tens of nanometers (nm).

A plurality of grooves 14*a* may be regularly arranged in the micro pattern part 14 form one pattern that is similar to the patterns found on the outer skins of living organisms, such as sharks or swordfish, that are capable of high speed swimming. Such, a predetermined pattern may be applied to the micro pattern part 14 using nano-biotechnology.

The micro pattern part 14 as described above may be formed in the supply flow path part 12 using a femtosecond laser 'L' after the supply flow path part 12 has been formed in the inkjet print head 10.

A process of forming the micro pattern part 14 using a femtosecond laser 'L' is as follows:

First, the femtosecond laser 'L' should irradiate light at a wavelength capable of penetrating the material that forms the inkjet print head 10, in particular, the material that composes the supply flow path part 12. For example, if the material that composes the supply flow path part 12 is silicon, a femtosecond laser 'L' emitting a wavelength capable of penetrating silicon is selected.

Next, while the femtosecond laser 'L' irradiates light from outside the inkjet print head 10, as the laser 'L' is brought into focus on the inner surface 12*a* of the supply flow path part 12 at which the micro pattern part 14 is to be formed, a laser ablation occurs at the focal portion of the laser 'L', which may form a predetermined pattern on the inner surface 12*a* of the supply flow path part 12. By using a femtosecond laser 'L', ablation at the focal portion of the laser 'L' may occur without deforming of the portion due to heat. Thus, high-precision pattern formation of complex shapes may be possible with a shorter patterning time with respect to the micro pattern part 14.

Figure 3:
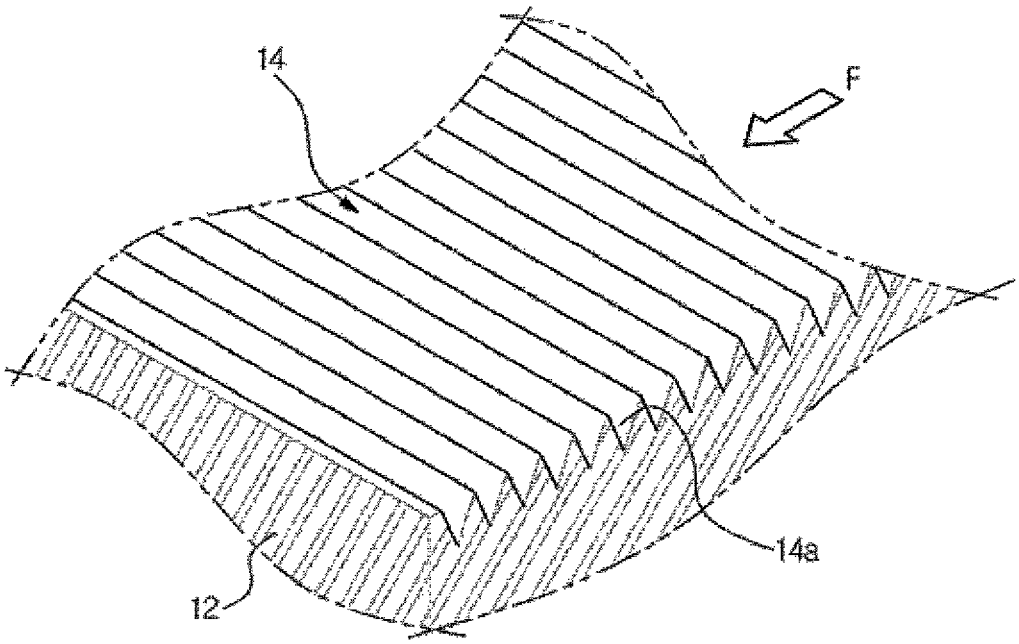
FIG. 3 illustrates a micro pattern part in accordance with one embodiment of the present disclosure.

FIG. 3 illustrates a micro pattern part in accordance with one embodiment of the present disclosure. Referring to FIG. 3, a plurality of grooves 14*a* is regularly arranged in the micro pattern part 14 to form one pattern. Each groove 14*a* has a cross section thereof in the approximate shape of a letter V, and the grooves 14 may extend lengthwise perpendicular to the direction of the flow 'F' of the fluid flowing through the micro pattern part 14. The depth and the width of each groove 14*a*, as illustrated in FIG. 3, may be constant. Alternatively, the depth and the width of the grooves 14*a* may vary, and furthermore, the gap between each of the plurality of grooves 14*a* may vary.

As described above, due to the pattern of the grooves 14*a* formed in the micro pattern part 14, turbulence occurs in the fluid flowing near the micro pattern part 14, which reduces the flow resistance of the ink.

Figure 4:
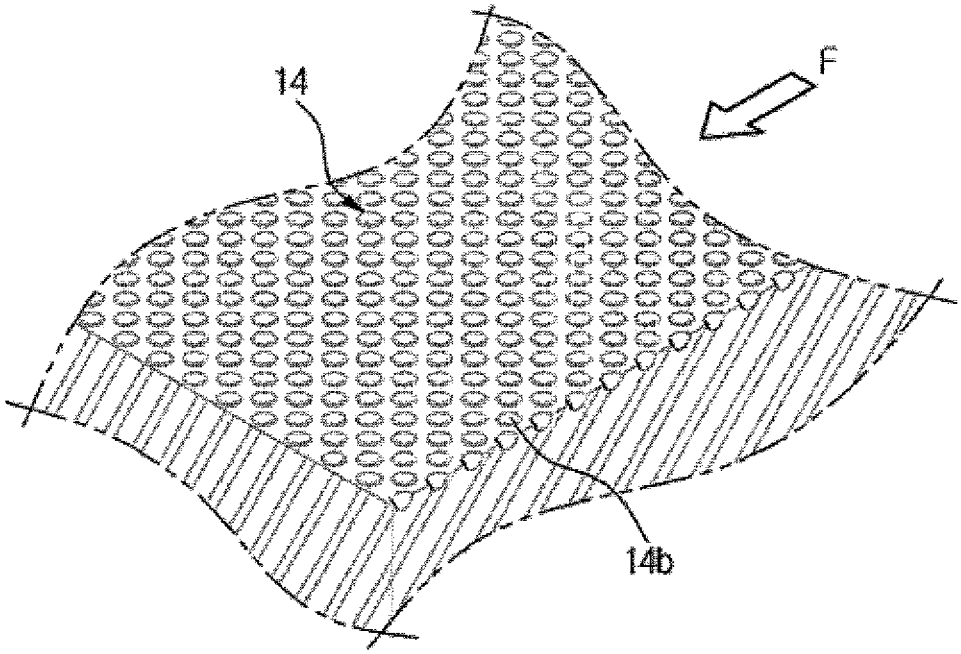
FIG. 4 illustrates a micro pattern part in accordance with another embodiment of the present disclosure.

FIG. 4 illustrates a micro pattern part in accordance with another embodiment of the present disclosure. Referring to FIG. 4, grooves 14*b* formed in the micro pattern part 14 are provided with a circular cross section, and thus each groove 14*b* has overall a semicircular shape.

The plurality of grooves 14*b* may be regularly arranged with gaps therebetween. Similar to the embodiment described with respect to FIG. 3, the pattern formed by the grooves 14*b* causes the occurrence of turbulence in the fluid flowing near the grooves 14*b*, which reduces the flow resistance of the ink.

Figure 5:
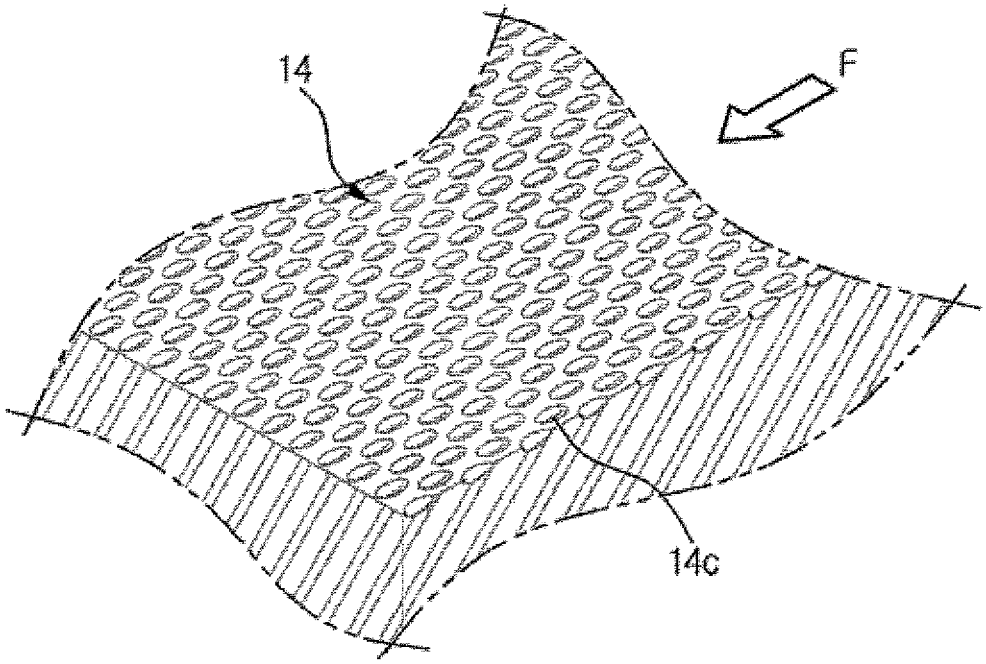
FIG. 5 illustrates a micro pattern part in accordance with still another embodiment of the present disclosure.

FIG. 5 illustrates a micro pattern part in accordance with still another embodiment of the present disclosure. Referring to FIG. 5, grooves 14*c* formed in the micro pattern part 14 have an elliptical cross section.

The plurality of grooves 14*c* may be regularly arranged with gaps therebetween. In particular, as illustrated, each groove 14*c* of the micro pattern part 14 may have its elliptical long axis parallel to the ink flow direction. Alternatively, the elliptical long axis of each groove 14*c* may be inclined with respect to the ink flow direction.

Figure 6:
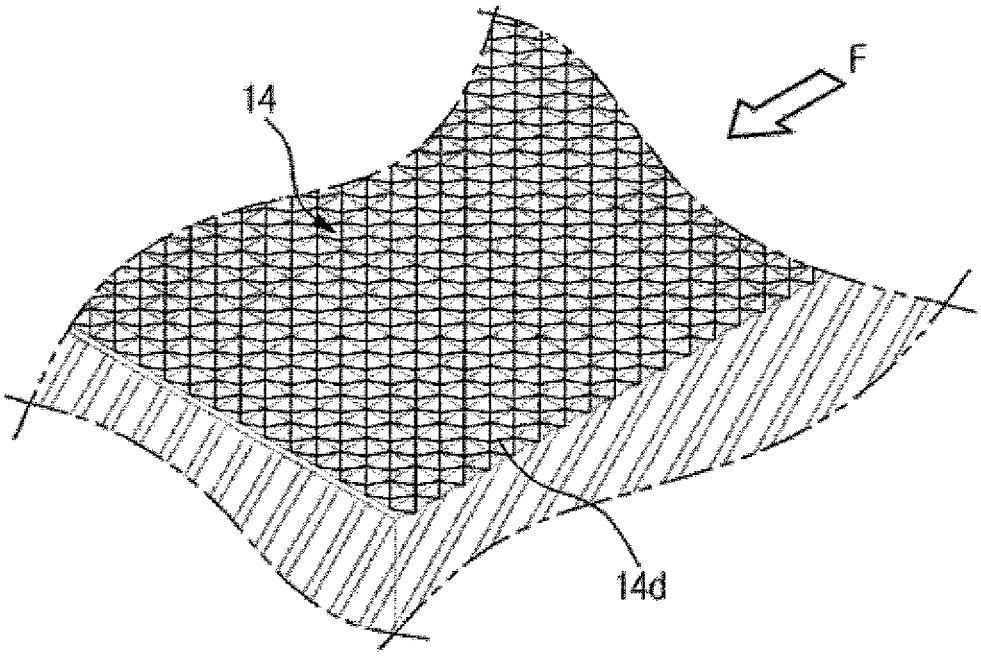
FIG. 6 illustrates a micro pattern part in accordance with still another embodiment of the present disclosure.

FIG. 6 illustrates a micro pattern part in accordance with still another embodiment of the present disclosure. Referring to FIG. 6, grooves 14*d* formed in the micro pattern part 14 may have a rhombus shaped cross section, and thus, each groove 14*d* may have a rectangular cone shape.

The plurality of grooves 14*d*, as illustrated, may be regularly arranged with gaps therebetween, or the adjacent grooves 14*d* may be irregularly arranged.

In addition, as illustrated, each rhombus shaped groove 14*d* may have its diagonal long axis inclined with respect to the ink flow direction, or parallel to the ink flow direction.

Referring to FIGS. 3 to 6, the groove shapes may have various forms in the micro pattern part 14, but these shapes are provided as examples, and the shapes of the groove in accordance with the present disclosure are not limited thereto. Thus, various modifications of the embodiments may include other patterns capable of reducing flow resistance of ink by inducing turbulence in the fluid flowing near the micro pattern part 14.

Although a few exemplary embodiments of the present disclosure have been shown and described, it would be appreciated by those skilled in the art that changes may be made in these embodiments without departing from the principles and spirit of the disclosure, the scope of which is defined by the following claims and their equivalents.

What is claimed is:

1. An inkjet print head, comprising:

a nozzle part configured to discharge ink;

a supply flow path part that defines a flow path to supply ink to be discharged from the nozzle part;

a driving part formed on at least one portion of the supply flow path part that is configured to provide a discharge pressure to the ink; and a micro pattern part formed on at least another one portion of the supply flow path part opposite of the driving part, said micro pattern being configured to reduce a flow resistance of ink that flows through the supply flow path part.

2. The inkjet print head of claim 1, wherein the micro pattern part has a plurality of grooves.

3. The inkjet print head of claim 2, wherein each groove has a V-Shaped cross section thereof.

4. The inkjet print head of claim 3, wherein each groove extends lengthways perpendicular to an ink flow direction through the flow path.

5. The inkjet print head of claim 2, wherein each groove has a circular cross section thereof.

6. The inkjet print head of claim 2, wherein each groove has an elliptical cross section thereof.

7. The inkjet print head of claim 6, wherein a long axis of each elliptical shape is parallel to an ink flow direction through the flow path.

8. The inkjet print head of claim 2, wherein each groove has a rhombus shaped cross section thereof.

9. The inkjet print head of claim 1, wherein the micro pattern part is formed using a femtosecond laser.

10. A method of manufacturing an inkjet print head having a supply flow path part that defines a flow path configured to supply ink to be discharged, the method comprising:

forming a micro pattern on a portion of the supply flow path part that is opposite of a driving part.

11. The method of claim 10, wherein: the micro pattern is formed using a femtosecond laser.

12. The method of claim 11, wherein the micro pattern part is formed to have a plurality of grooves.

13. The method of claim 11, wherein each groove has a V-shaped cross section thereof.

14. The method of claim 11, wherein each groove has a circular cross section thereof.

15. The method of claim 11, wherein each groove has an elliptical cross section thereof.

16. The method of claim 11, wherein a wavelength of the femtosecond laser is selected so that light emitted from the laser penetrates a material comprising the supply flow path part.

17. An inkjet print head, comprising:

a supply flow path part that defines a flow path to supply ink to be discharged from the inkjet print head;

a driving part formed on at least one portion of the supply flow path part that is configured to provide a discharge pressure to the ink; and a micro pattern part formed of a plurality of grooves on at least another one portion of the supply flow path part opposite of the driving part, said plurality of grooves configured to induce turbulence in the ink that flows through the supply flow path part, wherein said turbulence reduces a flow resistance of the ink flowing through the supply flow path part.

18. The inkjet print head of claim 17, further comprising a nozzle part connected to an end of the supply flow path part, said nozzle part being configured to discharge the ink.

19. The inkjet print head of claim 17, wherein each of the plurality of grooves has a V-shaped cross section and extends lengthways in a direction perpendicular to an ink flow direction.

20. The inkjet print head of claim 17, wherein each of the plurality of grooves has one of a circular cross section, an elliptical cross section, or a rhombus shaped cross section.

* * * * *